US012607436B2

(12) United States Patent
Tyner

(10) Patent No.: US 12,607,436 B2
(45) Date of Patent: Apr. 21, 2026

(54) SYSTEM AND METHOD FOR RECOVERY OF UNDAMAGED FRANGIBLE AERIAL TARGETS

(71) Applicant: Jimmy Brooks Tyner, Camarillo, CA (US)

(72) Inventor: Jimmy Brooks Tyner, Camarillo, CA (US)

( * ) Notice: Subject to any disclaimer, the term of this patent is extended or adjusted under 35 U.S.C. 154(b) by 0 days.

(21) Appl. No.: 19/275,184

(22) Filed: Jul. 21, 2025

(65) Prior Publication Data

US 2026/0049797 A1 Feb. 19, 2026

Related U.S. Application Data

(60) Provisional application No. 63/683,106, filed on Aug. 14, 2024.

(51) Int. Cl.
*F41J 9/16* (2006.01)
*F41J 11/00* (2009.01)

(52) U.S. Cl.
CPC *F41J 9/16* (2013.01); *F41J 11/00* (2013.01)

(58) Field of Classification Search
CPC ..... F41J 11/00; F41J 13/00; F41J 9/16; F41J 9/18
See application file for complete search history.

(56) References Cited

U.S. PATENT DOCUMENTS 1,271,864 A * 7/1918 Digney ..... F42C 15/42 114/240 R
5,340,057 A * 8/1994 Schmittle ..... B64C 29/02 244/7 B
5,634,638 A * 6/1997 Havens ..... A63B 71/022 473/421
5,655,766 A * 8/1997 Klebe, Jr. ..... A63B 71/022 473/421
7,297,076 B2 * 11/2007 Pohrer ..... A63B 61/04 473/421

(Continued)

FOREIGN PATENT DOCUMENTS

CN 202367121 U * 8/2012
CN 206101100 U * 4/2017

(Continued)

*Primary Examiner* — John E Simms, Jr.
*Assistant Examiner* — Amir A Klayman
(74) *Attorney, Agent, or Firm* — Ralph D Chabot

(57) ABSTRACT

A system and method for recovery of undamaged frangible aerial targets at shooting ranges includes a net positioned horizontally above ground level to cover a target fall zone. The net has mesh openings sized to retain undamaged frangible aerial targets while allowing damaged targets to pass through. The net forms a closed loop around parallel elongated front and rear rollers supported above ground by a plurality of fixed caster assemblies. A motor operatively coupled to at least one roller drives the net in a conveyor-like motion. Undamaged targets landing on the net are transported by the net to a collection area positioned adjacent to the front roller. The system may include friction strips on the rollers to enhance traction and a protective barrier shielding the collection area from stray shotgun pellets, thereby enabling recovery and reuse of targets that would otherwise break upon ground impact.

13 Claims, 6 Drawing Sheets

(56) References Cited

U.S. PATENT DOCUMENTS

| | | | | |
|---|---|---|---|---|
| 8,038,097 | B1 * | 10/2011 | Monson | B64F 1/027 244/110 E |
| 8,056,855 | B2 * | 11/2011 | Konstantinovskiy | F41H 11/02 89/36.17 |
| 8,668,603 | B2 * | 3/2014 | Hammons | A63B 47/025 473/421 |
| 9,770,640 | B1 * | 9/2017 | Kurz | E04H 15/04 |
| 9,862,503 | B2 * | 1/2018 | Chavez, Jr. | B64U 70/30 |
| 10,080,948 | B2 * | 9/2018 | Manieri | A63B 69/36 |
| 11,286,023 | B2 * | 3/2022 | Shinn | B63B 1/125 |
| 11,752,415 | B2 * | 9/2023 | Colling | A63B 71/022 473/421 |
| 2009/0308238 | A1 * | 12/2009 | Schwartz | F41J 13/00 89/36.02 |
| 2012/0187243 | A1 * | 7/2012 | Goldie | B64U 70/30 244/110 E |
| 2019/0241361 | A1 * | 8/2019 | Alatawi | B01D 46/681 |

FOREIGN PATENT DOCUMENTS

| | | | | |
|---|---|---|---|---|
| CN | 106639629 | A * | 5/2017 | G08C 23/04 |
| CN | 208902547 | U * | 5/2019 | |
| CN | 212739391 | U * | 3/2021 | |
| CN | 216944807 | U * | 3/2021 | |
| CN | 217826143 | U * | 11/2022 | |

* cited by examiner

SYSTEM AND METHOD FOR RECOVERY OF UNDAMAGED FRANGIBLE AERIAL TARGETS

FIELD OF THE INVENTION

The present invention relates to the field of target recovery.

BACKGROUND OF THE INVENTION

Target sports consist of several disciplines, one of which is to shoot a frangible aerial target, commonly referred to as a clay target, out of the air using a shotgun. The frangible aerial targets are available in various sizes and configurations to accommodate different shooting disciplines and skill levels. The standard clay target (also called a clay pigeon) used for most competitive shooting has a diameter of 110 mm (approximately 4.33 inches) by 25-26 mm high (approximately 1 inch) and weighs about 105 grams (approximately 3.7 ounces). These standard targets are the most commonly used size in competitive shooting for trap and skeet disciplines.

These frangible aerial targets are usually made from a mixture of materials which results in a target that has sufficient strength to be mechanically launched into the air at up to 70 mph yet brittle enough to be broken by the impact of what is commonly referred to as birdshot shotgun pellets.

The total number of targets used in the United States annually is estimated to be in excess of 20 million. The discipline that uses the most targets is trapshooting at an outdoor shooting range. In trapshooting, a squad of usually five shooters rotate across five posts spaced approximately 10 feet apart with each shooter firing at five targets per post for a total round of 25 per shooter and 125 per squad. The targets are launched from a trap machine which is located in a trap house situated a minimum of 16 yards downrange from the shooters. The targets are mechanically launched from an oscillating machine which is adjusted to throw the targets approximately 50 yards within a degree of target spread of between 35-45 degrees.

The cost of targets is typically the largest operating expense for most shotgun ranges. It is estimated the targets that are shot at are missed at the rate of 15% at private clubs with experienced shooters to as much as 50% at public ranges frequented by inexperienced shooters. Because of the brittle nature of targets, over 95% of targets missed by shooters break upon impact with the ground. The number of frangible aerial targets surviving ground impact are so small and scattered across the shooting range as to make them not economical to retrieve.

SUMMARY OF THE INVENTION

The present disclosure provides a system and method for recovery of undamaged frangible aerial targets at shooting ranges; particularly addressing the significant waste and expense associated with missed targets which become non-usable upon ground impact. The target recovery system utilizes a conveyor belt style net positioned horizontally above ground level. The net will preferably cover the area that missed frangible aerial targets would impact with the ground which will be referred to herein as the target fall zone.

The term "approximately", when used herein to describe length, means +/−ten percent (10%).

The system comprises a net having a mesh configuration with openings dimensioned to retain intact frangible aerial targets while permitting fragmented targets to pass therethrough. The net is configured as a continuous loop supported by parallel elongated rollers positioned at predetermined distances from one another. The net is maintained in a substantially horizontal orientation at an elevation above ground level sufficient to intercept descending targets within the target fall zone. The system further incorporates a motorized drive mechanism operatively coupled to at least one of the elongated rollers, thereby imparting rotational motion to the net assembly. This configuration enables the continuous transport of intact frangible aerial targets along the upper surface of the net toward a designated collection receptacle positioned adjacent to one of the elongated rollers, facilitating efficient recovery and subsequent reuse of the intact targets.

In a preferred embodiment, the net has dimensions of approximately 100 feet in width by 60 feet in length, configured to form a closed loop around the elongated rollers. The net has mesh openings measuring between 1.8 inches and 2.2 inches and most preferably 2 inches square, to retain intact frangible aerial targets while simultaneously permitting fragmented targets to pass therethrough. This dimensional configuration optimizes the system's efficiency by automatically segregating reusable targets from debris, thereby eliminating the need for manual sorting. The net is positioned horizontally at a predetermined elevation above ground level, covering an operational area of approximately 100 feet in width by 30 feet in depth, dimensions that have been determined to effectively encompass the statistical target fall zone for standard trapshooting configurations.

The elongated rollers, cylindrical in shape, are fabricated from a rigid material, preferably steel tubing having an outside diameter (OD) of approximately 1.25" and a length of approximately 100 feet. In one embodiment, each elongated roller is positioned within a plurality of fixed caster assemblies, disposed at predetermined intervals of approximately 5 feet along the length of each roller. Each fixed caster assembly comprises a structural configuration of three rotatable wheels: two fixed lower casters positioned to create a V-shaped support cradle with a predetermined gap therebetween sized to receive and support the elongated roller, and a fixed upper caster positioned above the roller and offset toward the opposing elongated roller. Each fixed caster, including both the lower and upper casters, has a wheel width of approximately 0.75 inch. The fixed upper caster maintains tension on the net through frictional engagement with the upper portion of the elongated roller. At least one of the elongated rollers, preferably the front elongated roller, is operatively coupled to a variable-speed electric motor configured to operate at low rotational velocities to drive the conveyor system.

The elongated front roller may incorporate friction-enhancing elements to optimize traction characteristics. In a preferred embodiment, a plurality of longitudinally-oriented friction strips are affixed to the outer cylindrical surface of the elongated front roller via an adhesive bonding agent, thereby enhancing the coefficient of friction at the net-roller interface during rotational operation. In a more preferred embodiment, the friction strips are strategically disposed longitudinally in the interstitial spaces between adjacent fixed caster assemblies. The friction strips are preferably arranged in a tripartite configuration, with three longitudinal rows circumferentially spaced at approximately 120-degree intervals around the outer surface of at least the elongated front roller and preferably both elongated rollers. This specific geometric arrangement of friction strips ensures that the strips do not interfere with the contact points between the caster assemblies and their respective elongated roller, while simultaneously providing additional frictional engagement to prevent relative slippage between the net and the elongated rollers during operation.

The system further comprises a collection area positioned adjacent to the elongated front roller, configured to receive undamaged frangible aerial targets as they are transported via the net's rotational movement. The collection area is dimensioned and positioned at a predetermined angle relative to the horizontal plane to facilitate gravitational transfer of the undamaged frangible aerial targets from the net as they traverse the apex of the elongated front roller. In a preferred embodiment, a protective barrier structure is strategically positioned forward of the collection area, oriented perpendicular to the trajectory of potential stray projectiles. This protective barrier structure is fabricated from ballistic-resistant material dimensioned to provide sufficient coverage to shield both the collection area and the accumulated undamaged frangible aerial targets from incidental impact by stray shotgun pellets, thereby preserving the structural integrity of the recovered targets and maintaining their suitability for subsequent reuse.

In some aspects, the techniques described herein relate to a system for recovery of undamaged frangible aerial targets at a shooting range including: a net having mesh openings to retain undamaged frangible aerial targets while allowing damaged frangible aerial targets to pass therethrough, the net positioned above ground level to cover at least a portion of a target fall zone; an elongated front roller and an elongated rear roller positioned substantially parallel to each other and spaced apart at a predetermined distance, wherein the net forms a closed loop around both elongated rollers; a plurality of support structures spaced along each respective elongated roller at predetermined intervals for supporting the respective elongated roller above ground level; a motor operatively coupled at least to one of the elongated rollers to impart rotational motion; and a collection area positioned adjacent to the elongated front roller for receiving undamaged frangible aerial targets from the net.

In some aspects, the techniques described herein relate to a system located at a shooting range for recovery of undamaged frangible aerial targets including: a net adapted to act as a closed loop conveyor belt between at least an elongated rear roller and an elongated front roller; the net covering at least a portion of a target fall zone; the net having mesh openings sufficient to retain undamaged frangible aerial targets while allowing damaged targets to pass thru; at least one motor operatively connected to the elongated front roller; each elongated roller supported above a ground surface; a collection area positioned adjacent to the elongated front roller for receiving undamaged clay targets transported by the net; a plurality of elongated friction strips positioned longitudinally along a length of each of the elongated front roller and the elongated rear roller, the elongated friction strips spaced approximately 120 degrees apart about a circumference of each respective elongated roller; a plurality of fixed caster assemblies supporting each of the elongated front roller and the elongated rear roller, each fixed caster assembly positioned around the respective elongated roller and including at least two fixed lower casters and a fixed upper caster; and a protective barrier positioned in front of the collection area opposite the elongated front roller.

In some aspects, the techniques described herein relate to a method for recovering undamaged frangible aerial targets at a shooting range including: a) providing a conveyor system including: a net having mesh openings to retain undamaged frangible aerial targets while allowing damaged frangible aerial targets to pass through; an elongated front roller and an elongated rear roller positioned substantially parallel to each other and elevated above ground level, wherein the net forms a closed loop around the elongated front roller and elongated rear roller; a motor operatively coupled to at least one of the rollers to impart rotational motion; a collection area positioned adjacent to the elongated front roller; b) positioning the conveyor system to cover a target fall zone of the shooting range; c) activating the motor to cause the net to move in a direction from the elongated rear roller toward the elongated front roller; d) catching undamaged frangible aerial targets on the upper surface of the net; and e) transporting the undamaged frangible aerial targets on the upper surface of the net to the collection area.

By enabling the recovery and reuse of undamaged frangible aerial targets, the disclosed system and method significantly reduces the operating costs of shotgun ranges while providing environmental benefits through waste reduction.

DETAILED DESCRIPTION OF THE PREFERRED EMBODIMENT

The figures presented herein are for illustrative purposes and the illustrated parts are not necessarily shown in correct proportion or scale.

Figure 1:
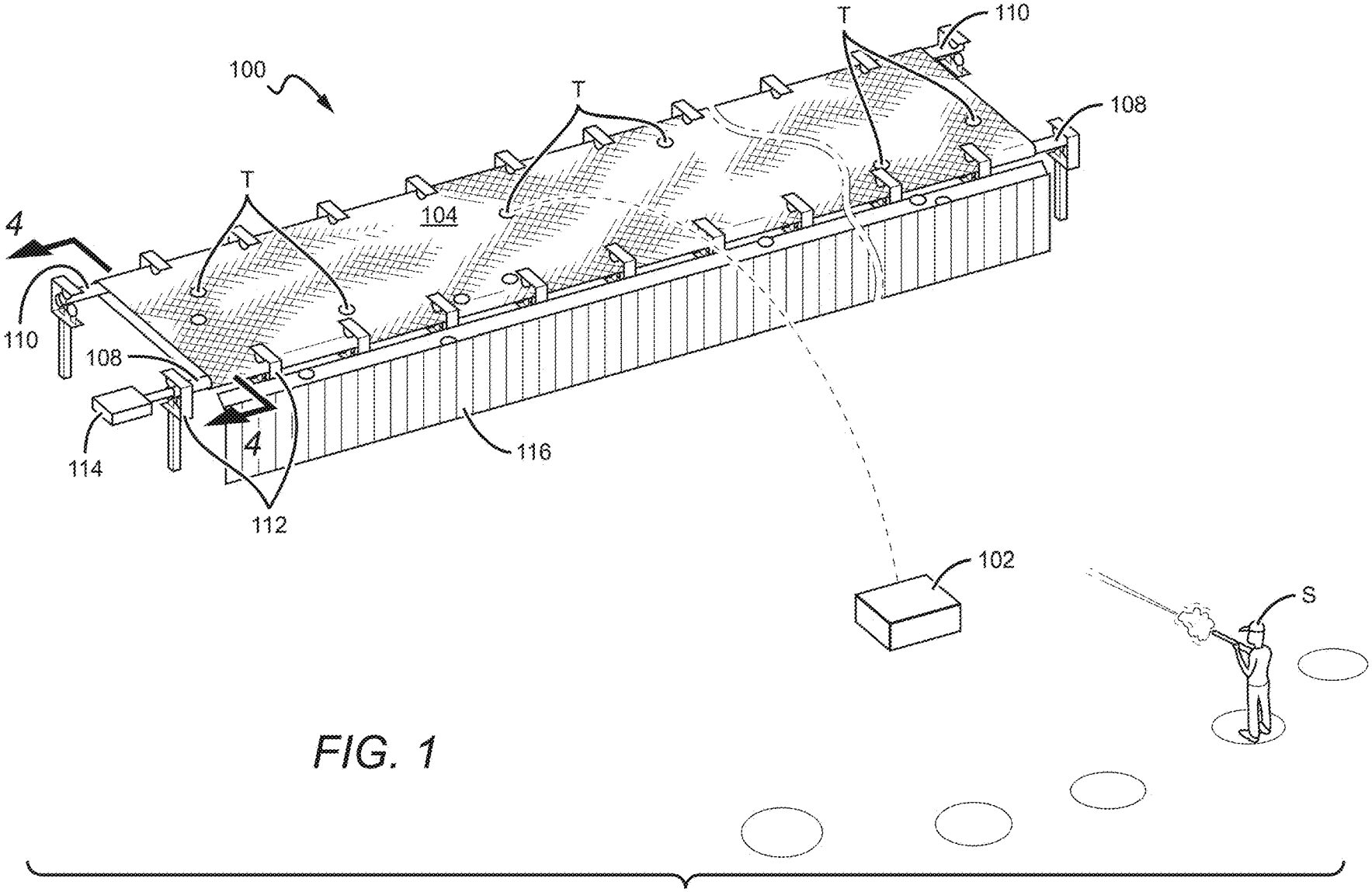
FIG. 1 is a perspective view of a target range utilizing the disclosed method and system.
Figure 2:
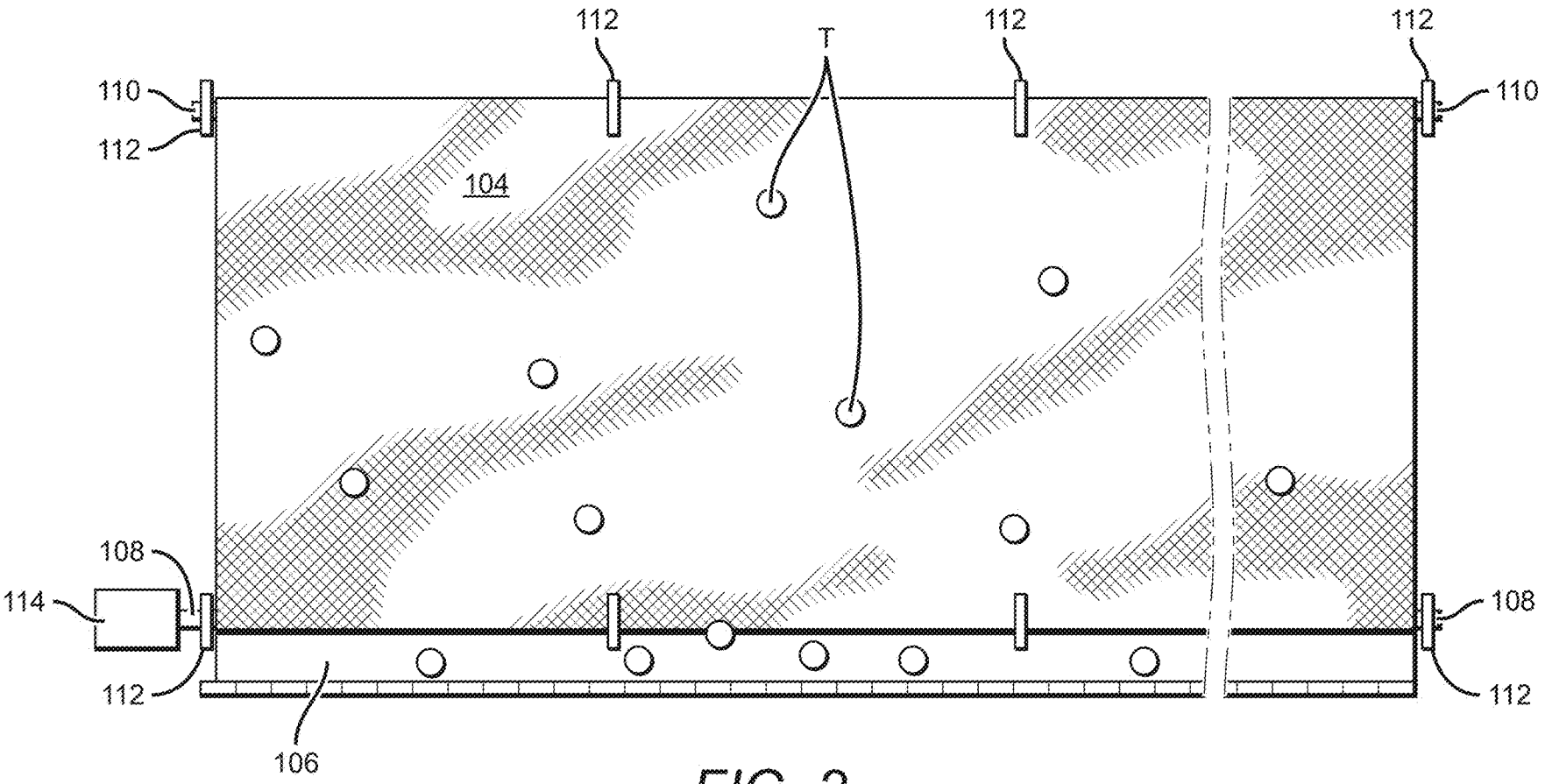
FIG. 2 is a top view of the system of FIG. 1.

An example of a target range utilizing the disclosed method and system 100 is illustrated in FIG. 1. Typically, Shooter S stands approximately 16 yards in front of a trap machine (not shown) housed within a trap house 102 which launches frangible aerial targets T within a 75 degree arc approximately 50 yards.

System 100 includes a net 104 for collecting undamaged frangible aerial targets T. Net 104 has mesh openings that measure between 1.8 inch and 2.2 inch. Net 104 is positioned horizontally above ground level G to cover the target fall zone.

Figure 4:
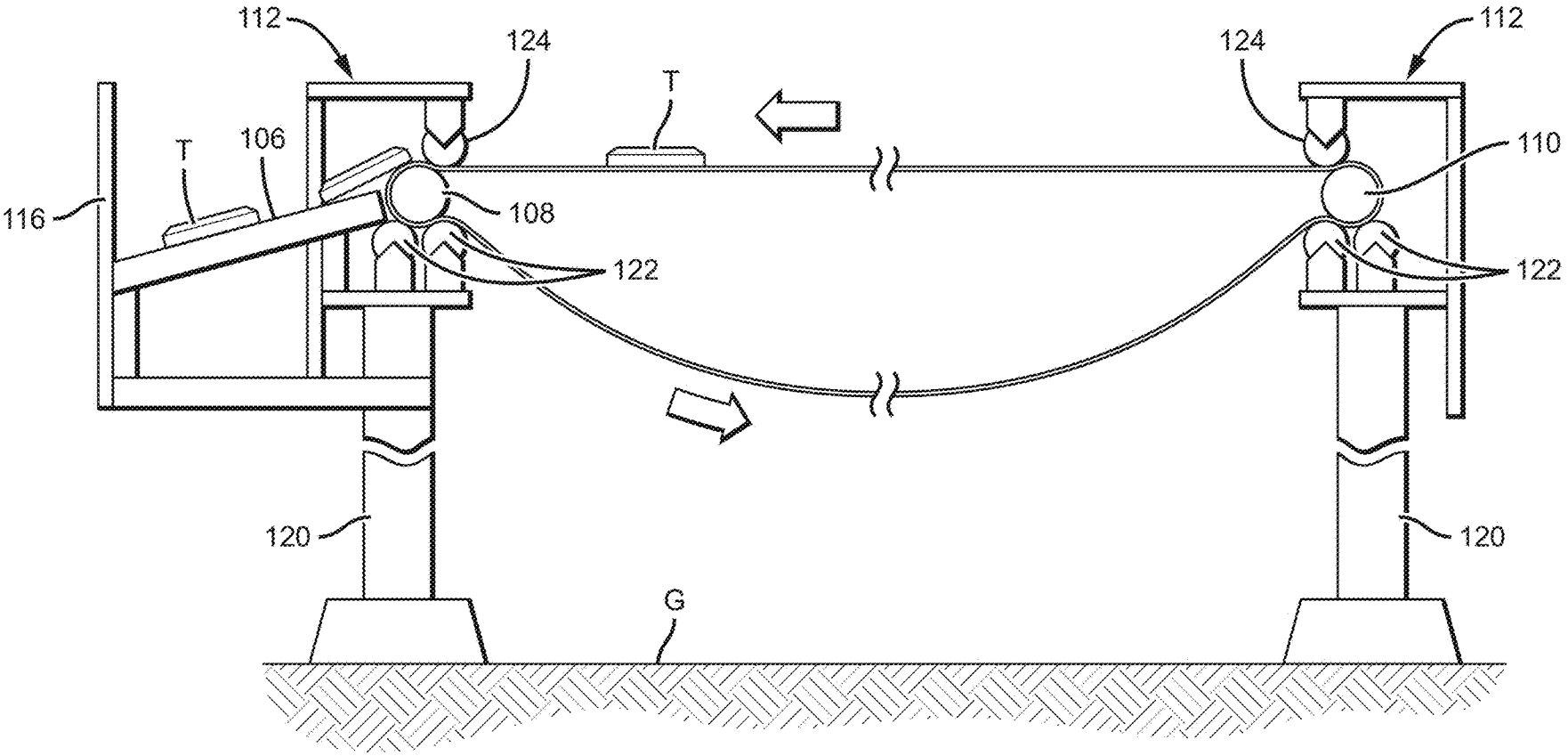
FIG. 4, is a side view along line 4-4 of FIG. 1.

System 100 further includes an elongated front roller 108 and a elongated rear roller 110, each elongated roller is approximately 100 ft in length positioned between a caster assembly positioned on respective supports 120 which will be described later. Elongated rollers 108 and 110 are parallel to one another spaced approximately 30 feet apart. Both elongated rollers 108 and 110 are made of 1.25" OD steel pipe. Net 104 is positioned around both rollers to create a closed loop conveyor belt as best illustrated in FIG. 4. Net 104 is approximately 60 feet in length by 100 feet wide.

A plurality of support structures 120 are spaced along each respective elongated roller at predetermined intervals of five feet for supporting the respective elongated roller above ground level.

Figure 5:
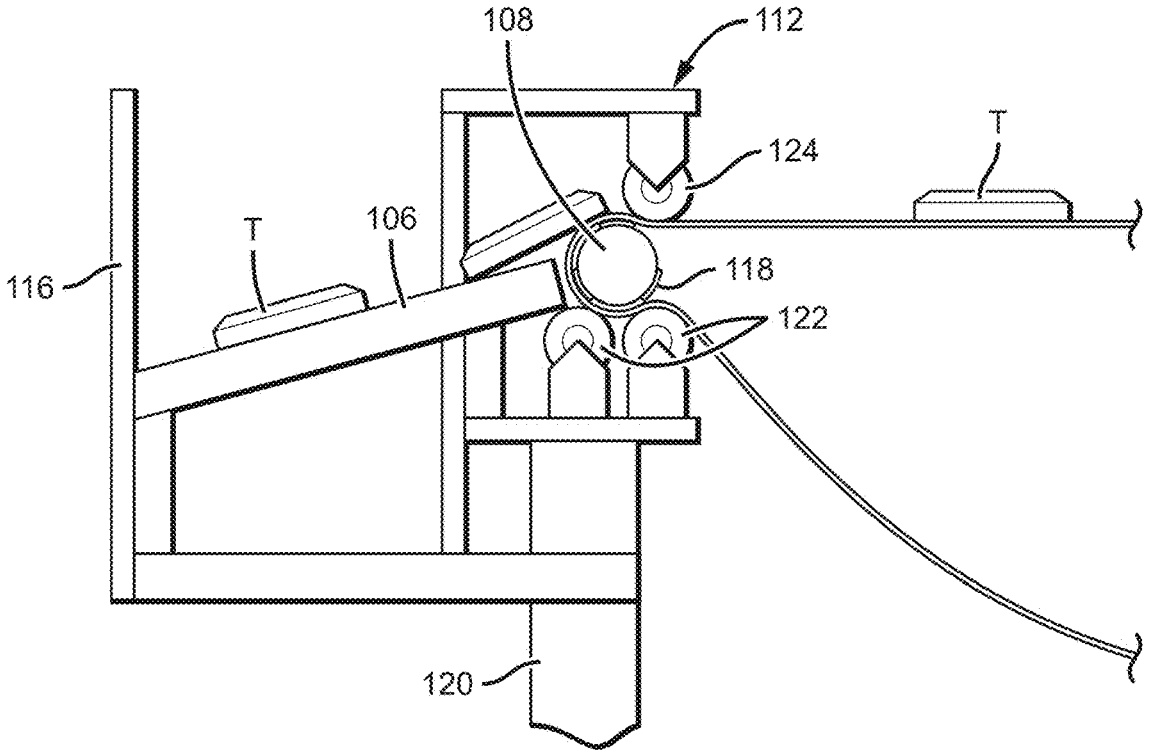
FIG. 5 is a close up view of the elongated front roller and support illustrated in FIG. 5.
Figure 7:
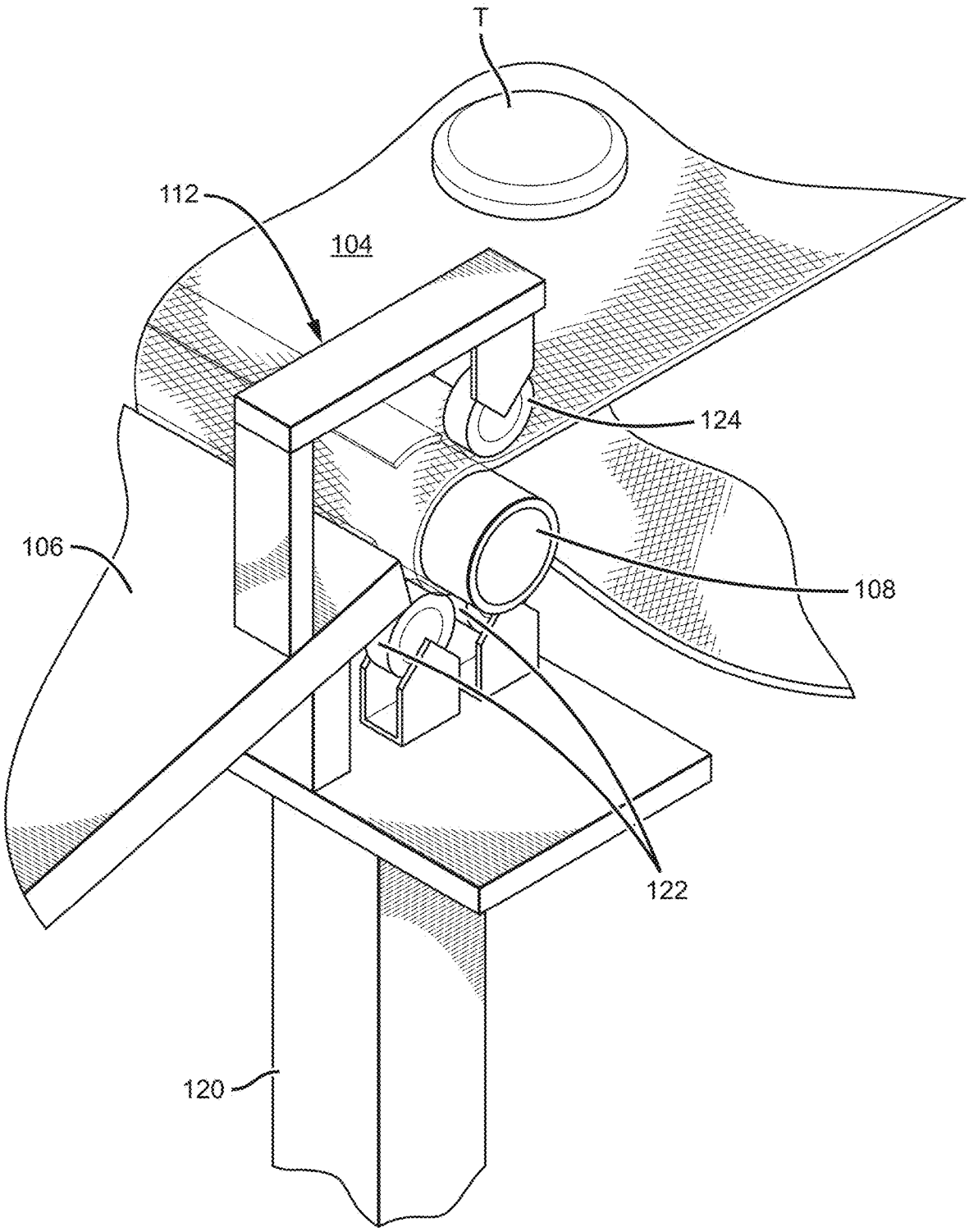
FIG. 7 is a perspective view illustrating the position of an elongated roller and netting between the casters.

Each of the plurality of support structures 120 support a respective caster assembly 112, as shown in FIGS. 4, 5 and 7. Each caster assembly 112 comprises a pair of fixed lower casters 122 and a fixed upper caster 124, wherein the respective elongated roller is positioned between the pair of fixed lower casters and the fixed upper caster. A total of 21 caster assemblies are used for each elongated roller with a caster assembly positioned at 5 foot intervals along each elongated roller. The fixed lower casters 122 support elongated rollers 108, 110 in a V-type configuration, and the upper caster 124 is positioned offset and closer to the opposing elongated roller. Upper caster 124 maintains the tension on net 104 by frictional engagement with the respective elongated roller.

Figure 6:
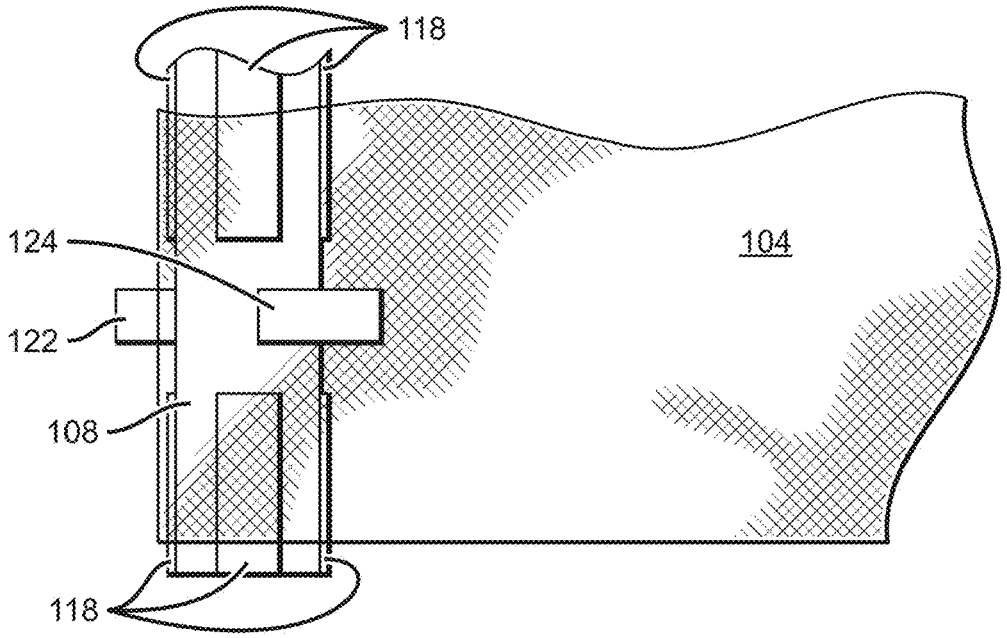
FIG. 6 is a top close up view of a portion of net 104 and position of casters and friction strips on an elongated roller.

The elongated front roller 108 is operatively coupled to an electric motor 114 configured to operate at low rotational velocities to drive the conveyor system. The electric motor 114 used was a 30 watt, 100 KG load electric rotisserie motor. To mitigate potential slippage between net 104 and the rotating elongated rollers 108, 110 during operational cycles, each elongated roller incorporates a plurality of longitudinally-oriented friction strips 118 that enhance the coefficient of friction at the net-roller interface, as depicted in FIG. 6. Each friction strip 118 exhibits dimensional parameters of approximately 1 inch in width by 4.5 feet in length and is permanently affixed to the respective elongated roller via an adhesive bonding agent in the interstitial longitudinal space between adjacent caster assemblies. The friction strips 118 are strategically disposed in a tripartite configuration, with three longitudinal rows circumferentially spaced at approximately 120-degree intervals around the outer cylindrical surface of each elongated roller. Each friction strip 118 is fabricated from a coarse weave material specifically selected for its high-friction characteristics.

When motor 114 is activated, the upper surface of net 104 displaces in a direction from elongated rear roller 110 to elongated front roller 108 as illustrated in FIG. 4. The operational coverage area of net 104 encompasses approximately 100 feet by 30 feet. For optimal system performance, net 104 is preferably maintained in continuous rotational motion during periods when frangible aerial targets T are being ballistically projected. Intact frangible aerial targets T, upon impact with the upper surface of net 104, are subjected to conveyance via the translational motion of the net toward and subsequently over the apex of elongated front roller 108, whereupon they undergo gravitational descent onto collection area 106 as illustrated in FIGS. 2, 3, 4 and 5. Following accumulation in collection area 106, the structurally intact frangible aerial targets T remain available for manual extraction by authorized range personnel for subsequent redeployment in shooting activities.

Figure 3:
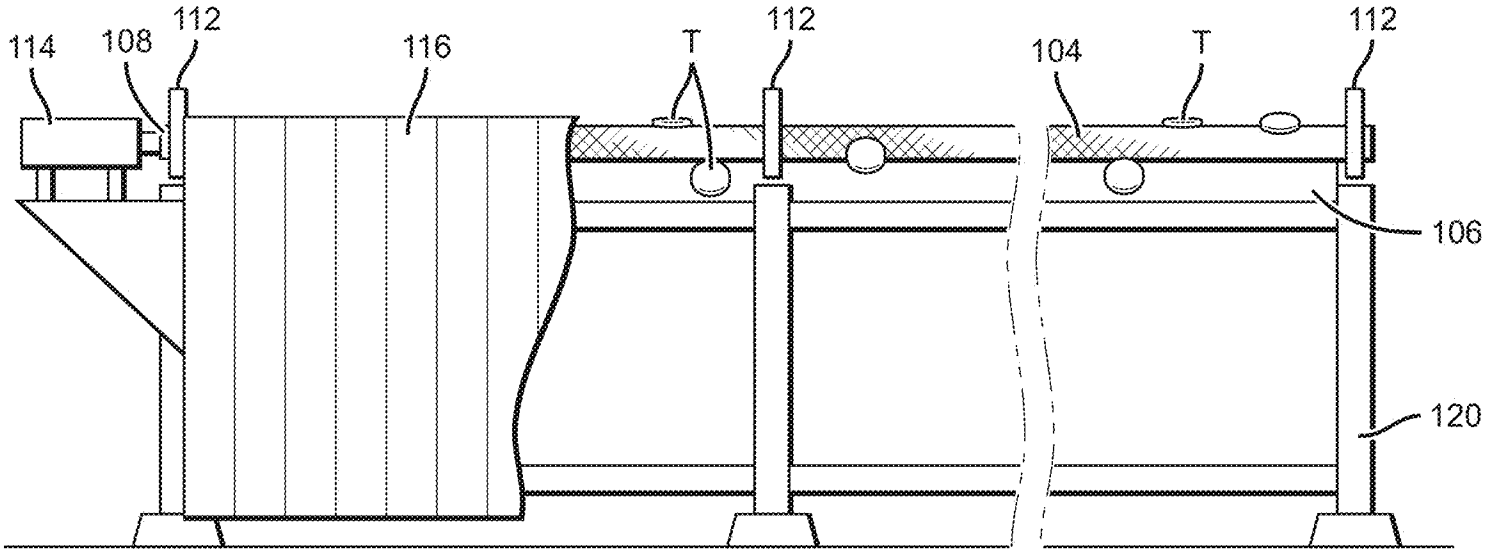
FIG. 3 is a front view of the disclosed system.

As illustrated in FIGS. 1 and 3, a protective barrier 116 can be used to shield net 104, collection area 106 and collected frangible aerial targets T from stray shotgun pellets.

The method for recovering undamaged frangible aerial targets at a shooting range is as follows:

providing a conveyor system that comprises:

a net having mesh openings to retain undamaged frangible aerial targets while allowing damaged frangible aerial targets to pass through; an elongated front roller and an elongated rear roller positioned substantially parallel to each other and elevated above ground level, wherein the net forms a closed loop around the elongated front roller and elongated rear roller; a motor operatively coupled to at least one of the rollers to impart rotational motion; and a collection area positioned adjacent to the elongated front roller; positioning the conveyor system to cover a target fall zone of the shooting range;

activating the motor to cause the net to move in a direction from the elongated rear roller toward the elongated front roller;

catching undamaged frangible aerial targets on an upper surface of the net; and transporting the undamaged frangible aerial targets on the upper surface of the net to the collection area.

I claim:

1. A system for recovery of undamaged frangible aerial targets at a shooting range comprising:

a net having mesh openings to retain undamaged frangible aerial targets while allowing damaged frangible aerial targets to pass therethrough, the net positioned above ground level to cover at least a portion of a target fall zone;

an elongated front roller and an elongated rear roller positioned substantially parallel to each other and spaced apart at a predetermined distance, wherein the net forms a closed loop around both elongated rollers;

a plurality of support structures spaced along each respective elongated roller at predetermined intervals for supporting the respective elongated roller above ground level, wherein each of the plurality of support structures comprises a caster assembly, each caster assembly comprising a pair of fixed lower casters and a fixed upper caster, wherein the respective elongated roller is positioned between the pair of fixed lower casters and the fixed upper caster, wherein the predetermined intervals are approximately five feet along a length of each elongated roller;

a motor operatively coupled at least to one of the elongated rollers to impart rotational motion;

a collection area positioned adjacent to the elongated front roller for receiving undamaged frangible aerial targets from the net; and a plurality of elongated friction strips positioned longitudinally along a length of the elongated front roller and spaced approximately 120 degrees apart about a circumference of the elongated front roller.

2. The system of claim 1 further comprising a protective barrier positioned in front of the collection area opposite the elongated front roller.

3. The system of claim 2 wherein each friction strip has a length substantially equal to the distance between adjacent sets of fixed lower casters along the elongated front roller.

4. The system of claim 1 wherein a plurality of elongated friction strips are positioned longitudinally along a length of the elongated rear roller and spaced approximately 120 degrees apart about a circumference of the elongated rear roller.

5. The system of claim 4 wherein the mesh openings of the net measure between 1.8 inch and 2.2 inch.

6. The system of claim 4 wherein each friction strip on the elongated rear roller has a length substantially equal to the distance between adjacent sets of fixed lower casters along the elongated rear roller.

7. A system located at a shooting range for recovery of undamaged frangible aerial targets comprising:

a net adapted to act as a closed loop conveyor belt between at least an elongated rear roller and an elongated front roller; the net covering at least a portion of a target fall zone; the net having mesh openings sufficient to retain undamaged frangible aerial targets while allowing damaged targets to pass thru;

at least one motor operatively connected to the elongated front roller;

each elongated roller supported above a ground surface;

a collection area positioned adjacent to the elongated front roller for receiving undamaged clay targets transported by the net;

a plurality of elongated friction strips positioned longitudinally along a length of each of the elongated front roller and the elongated rear roller, the elongated friction strips spaced approximately 120 degrees apart about a circumference of each respective elongated roller;

a plurality of fixed caster assemblies supporting each of the elongated front roller and the elongated rear roller, each fixed caster assembly positioned around the respective elongated roller and comprising at least two fixed lower casters and a fixed upper caster; and a protective barrier positioned in front of the collection area opposite the elongated front roller.

8. The system of claim 7 wherein the mesh openings of the net measure between 1.8 inch and 2.2 inch.

9. A method for recovering undamaged frangible aerial targets at a shooting range comprising:

a) providing a conveyor system comprising:

a net having mesh openings dimensioned to retain undamaged frangible aerial targets while allowing damaged frangible aerial targets to pass through;

an elongated front roller and an elongated rear roller positioned substantially parallel to each other and elevated above ground level, wherein the net forms a closed loop around the elongated front roller and elongated rear roller;

a motor operatively coupled to at least one of the elongated rollers to impart rotational motion;

a collection area positioned adjacent to the elongated front roller;

b) positioning the conveyor system to cover a target fall zone of the shooting range;

c) activating the motor to cause the net to move in a direction from the elongated rear roller toward the elongated front roller;

d) catching undamaged frangible aerial targets on an upper surface of the net; and c) transporting the undamaged frangible aerial targets on the upper surface of the net to the collection area.

10. The method of claim 9 wherein the mesh openings of the net measure between 1.8 inch and 2.2 inch.

11. The method of claim 9 further comprising:

providing a plurality of caster assemblies spaced at predetermined intervals along a length of each elongated roller, each caster assembly comprising a pair of fixed lower casters positioned to support a respective elongated roller and a fixed upper caster positioned above the respective elongated roller.

12. The method of claim 11, wherein the predetermined intervals are approximately five feet along the length of each elongated roller.

13. The method of claim 12 wherein the mesh openings of the net measure between 1.8 inch and 2.2 inch.

* * * * *